US007378981B1

(12) United States Patent
Sachs

(10) Patent No.: US 7,378,981 B1
(45) Date of Patent: May 27, 2008

(54) TIP JAR PROVIDING AUDIBLE AND VISIBLE SIGNALS

(76) Inventor: Gerald W Sachs, 4034 Lake Blvd., Clearwater, FL (US) 33762

( * ) Notice: Subject to any disclaimer, the term of this patent is extended or adjusted under 35 U.S.C. 154(b) by 218 days.

(21) Appl. No.: 11/306,269

(22) Filed: Dec. 21, 2005

(51) Int. Cl.
*G08B 3/00* (2006.01)

(52) U.S. Cl. ..... 340/691.2; 340/384.1; 446/397

(58) Field of Classification Search ..... 340/691.2
See application file for complete search history.

(56) References Cited

U.S. PATENT DOCUMENTS

| | | | | |
|---|---|---|---|---|
| 1,704,865 | A | 3/1929 | McClintock | 109/38 |
| 4,299,041 | A | 11/1981 | Wilson | 40/124.02 |
| 5,536,196 | A | 7/1996 | Sternberg | 446/81 |
| 5,594,409 | A * | 1/1997 | Shank | 340/326 |
| 5,644,298 | A | 7/1997 | Brooks et al. | 340/612 |
| 5,716,211 | A * | 2/1998 | Vetter | 434/107 |
| 5,730,165 | A | 3/1998 | Philipp | 137/1 |
| 6,298,990 | B1 | 10/2001 | Amrod et al. | 206/459.1 |
| 6,454,570 | B1 * | 9/2002 | Woods | 434/107 |
| 6,505,734 | B2 | 1/2003 | Su | 206/217 |
| 6,737,959 | B2 | 5/2004 | Ho | 340/384.1 |
| 6,902,459 | B2 * | 6/2005 | Kim | 446/8 |
| 7,059,477 | B2 * | 6/2006 | Wolf et al. | 209/373 |
| 7,321,304 | B1 * | 1/2008 | Soffer | 340/571 |
| 2005/0155913 | A1 * | 7/2005 | Wolf et al. | 209/233 |

* cited by examiner

*Primary Examiner*—George A Bugg
(74) *Attorney, Agent, or Firm*—David Kiewit

(57) ABSTRACT

A tip jar system comprises a receptacle for receiving a deposit of money and a signaling apparatus for sensing the presence of a person depositing the money in the receptacle and for responding to the sensed presence. The signal provided is generally of an amusing sort and preferably provides both audible and visible iconic simulation of a familiar action that is unrelated to the actual deposit. The preferred signaling apparatus uses an array of light sources configured to simulate a trajectory of an object involved in the familiar action. The signaling apparatus also provides a sound output to generate the simulation having both visual and audible components.

10 Claims, 3 Drawing Sheets

TIP JAR PROVIDING AUDIBLE AND VISIBLE SIGNALS

BACKGROUND INFORMATION

The invention relates to a system responsive to placement of currency in a container therefor, and, more specifically to a tip jar for providing both audible and visual indications when money is deposited.

Receptacles for collecting tips are widely used in restaurants and bars. These are commonly jars, goldfish bowls and the like, that are commonly selected to be transparent in order to show a currently present customer that previous customers have contributed tips and to thereby motivate the currently present customer to put money in the jar. In addition to the display of tips, some establishments encourage their staff to thank customers for contributing and to do so loudly enough that others customers hear the message and are thereby motivated to contribute. Sometimes, the 'thank you' message is delivered non-verbally and often in an amusing way, e.g., by a staff member ringing a bell whenever he or she sees a customer depositing money into the tip jar.

BRIEF SUMMARY OF THE INVENTION

Thus, one goal of the invention is to provide an arrangement that automatically and reliably provides a recognition signal whenever money is put into a tip jar. This will provide a more consistent motivation than is provided by manually operated gongs and the like that are only used when a staff member is available to manually operate them.

Another goal of the invention is to alert an employee who is close to a tip jar whenever a customer accesses the jar. This provides the employee with an opportunity to personally thank the customer for the tip, or to take appropriate action in case the customer is attempting to steal money from the tip jar.

One aspect of the invention is that it provides a system comprising, in combination, a receptacle for receiving a deposit of money and a signaling apparatus for responding to presence of a person depositing the money in the receptacle. The signal provided is generally of an amusing sort and preferably provides a simulation of a familiar action unrelated to the deposit. In a preferred system, the receptacle is a jar comprising a base and an upstanding wall surrounding the base so as to define a mouth portion of the receptacle. In contrast to ordinary receptacles, a preferred receptacle of the invention also comprises a capacitive sensing plate adjacent the mouth portion. The preferred signaling apparatus comprises a housing retaining an array of light sources configured to simulate a familiar trajectory of something or another so as to provide an iconic representation of the unrelated action. Thus, when a customer adds money to the tip jar, a capacitive sensing circuit electrically connected to the plate can provide an output indicative of his or her presence. This output may be supplied to a controller operable to provide respective outputs to the light sources in the array thereof and to a sound output device to generate the simulation having both visual and audible components.

The events simulated by the audible and visible display elements of the invention are preferably events that are familiar to the user and that involve a characteristic trajectory of some simulated object. Usually, the end point of the characteristic trajectory is marked by a characteristic sound. In a particular preferred embodiment, the simulated event is a test-of-strength game familiar to anyone who has ever attended a carnival. In this case the simulated object is a mass constrained to travel vertically upward so as to strike a gong. In another embodiment an arcuate trajectory of a golf ball is simulated by placement of LEDs in a housing and the end of the ball's flight is marked by a sound simulative of either a cheering crowd or an impact of the ball in a water hazard.

Although it is believed that the foregoing rather broad summary description may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed in the following Detailed Description as a basis for designing other arrangements for carrying out the same purposes of the present invention and that such equivalent constructions are within the spirit and scope of the invention in its broadest form. Moreover, it may be noted that different embodiments of the invention may provide various combinations of the recited features and advantages of the invention, and that less than all.

DETAILED DESCRIPTION OF THE INVENTION

In studying this Detailed Description, the reader may be aided by noting definitions of certain words and phrases used throughout this patent document. Wherever those definitions are provided, those of ordinary skill in the art should understand that in many, if not most instances, such definitions apply to both preceding and following uses of such defined words and phrases. At the outset of this Description, one may note that the terms "include" and "comprise," as well as derivatives thereof, mean inclusion without limitation; the term "or," is inclusive, meaning and/or.

Figure 1:
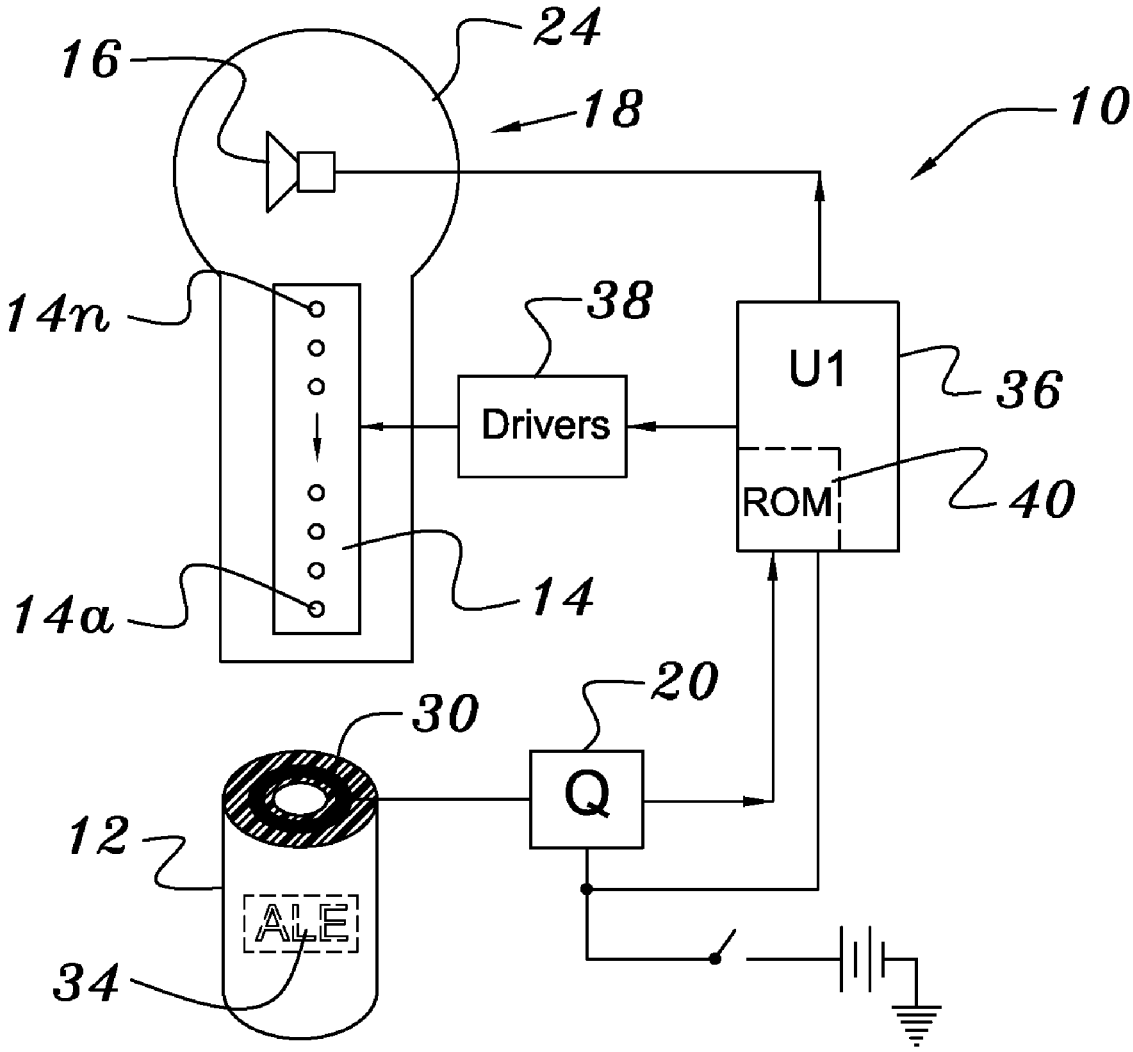
FIG. 1 is a schematic block diagram of an audible and visual signaling system of the invention in which a receptacle is partially sectioned to show a capacitive plate that would otherwise be hidden from view.

Turning now to FIG. 1, one finds a schematic representation of a preferred system 10 of the invention comprising a receptacle 12 for receiving tips, an LED array 14 and a sound output device 16 disposed in a suitable housing 18, and an electronic circuit 20 for sensing the presence of a customer 21 depositing a tip 22 into the receptacle.

The LED array 14 and sound output device 16, which may be a speaker, are configured so as to provide an audible and visual simulation of a familiar event that has no necessary relationship to the act of depositing money in a tip jar, but that generally involves some familiar object moving along a characteristic trajectory that has an end point marked by a characteristic sound. For example, the LEDs 14 may be configured as a vertical linear array within an upstanding portion of a housing 18 adjacent, or integrally attached to the tip jar 12, as schematically depicted in FIG. 1. The speaker, in this case, may be disposed in a generally round top portion 24 of the housing 18. In this embodiment, when a customer accesses the tip jar 12 the LEDs 14 in the array are illuminated sequentially, starting with the bottom-most LED 14*a* and ending with the top one 14*n*, and a sound representative of a gong is output by the speaker 16 at the end of the illumination sequence. This simulates the familiar carnival midway 'test of strength' game in which a participant strikes a lever to propel a metal body upwards along a vertical rail (as simulated by the LEDs) to strike a gong.

In the several preferred embodiments herein described and depicted, the visual simulation of an object's trajectory are provided by a single curvilinear array of LEDs. Those skilled in the art will recognize that other LED arrangements (e.g., an array comprising a single strand of LEDs bordered, at one end, by other strands in order to provide a broader portion of the path) could also be employed. Moreover, other display technologies, such as a backlit liquid crystal display panel, could also be used to provide a representation of a simulated trajectory.

In preferred embodiments, a capacitive presence sensor 20 is employed to determine when a customer 21 places money 22 in the jar 12. In particular preferred embodiments the tip jar 12 is a generally cylindrical, cup-like body having a base 26 surrounded by an upstanding wall 28 and having a wire loop 30 embedded in the wall around the mouth 32 of the jar 12. This loop serves as a capacitive sensing plate that is connected to a capacitive sensing circuit, which is preferably of the charge transfer sensing variety and which may be a Model QT113 device supplied by QRG, Ltd., of Southampton, UK. As is known in the capacitive sensing arts, the distance from the mouth of the jar at which presence is declared to be detected can be selected by the use of suitable trimming components (not shown) attached to the capacitive sensing circuit 20. Those skilled in the art will realize that although a particular capacitive sensing approach is preferred, many other capacitive sensing approaches are known, as are non-capacitive presence sensors, that, for example, use infra-red photoemitter-photodetector pairs. Moreover, although the preferred embodiment uses an embedded wire loop as the sensing plate, those skilled in the proximity detection arts will recognize that many other choices are possible and include conductive layers disposed within an advertising label 34 on the jar.

In preferred embodiments an output from the presence sensor 20 is supplied to a microcontroller 36, which is preferably any one of several available devices optimized for synthesizing voice or sounds. These include, but are not limited to the Model SNC312 supplied by Sonix Technology Corporation and the Model W588S003 supplied by Winbond Electronics Corporation of America. Although the choice of one of these devices allows for a direct output from the microcontroller 36 to the speaker 16, those skilled in the control arts will recognize that there are many other ways of providing a selected sound output and that these include, but are not limited to, the use of other controllers in combination with suitable external drivers to drive the speaker, as well as the use of older technology, such as a combination of fixed logic and a magnetic tape player.

In the preferred embodiment, output ports of the microcontroller are used in combination with external driver circuitry 38 to control individual light emitting diodes 14*a*-14*n* to generate the desired illumination sequence. In the preferred embodiment using a sound-synthesizing controller and a linear array of sixteen LEDs, the driver circuitry 38 may comprise two sets of transistors. This may comprise a first set of four PNP transistors (e.g., PN2907), all of which have their emitters connected to a positive voltage source, and each of which has its base connected to a respective one of the controller's output ports and its collector connected to the cathodes of four of the LEDs. A corresponding set of four NPN transistors (e.g., NP2222A) has all four emitters grounded and each of the transistors has its base separately connected to a respective one of the output ports and its collector connected to the cathodes of four of the LEDs. By appropriately pulsing the bases of the two transistor arrays, any one of the LEDs can be individually turned on, and, of course, the entire array of LEDs can be fired in sequence.

In preferred embodiments the controller 36 operates under control of a program stored in computer memory 40. The memory 40 is also preferably used to store a digital representation of whatever sounds are to be output, as is conventional in the use of controllers optimized for sound synthesis.

Figure 2:
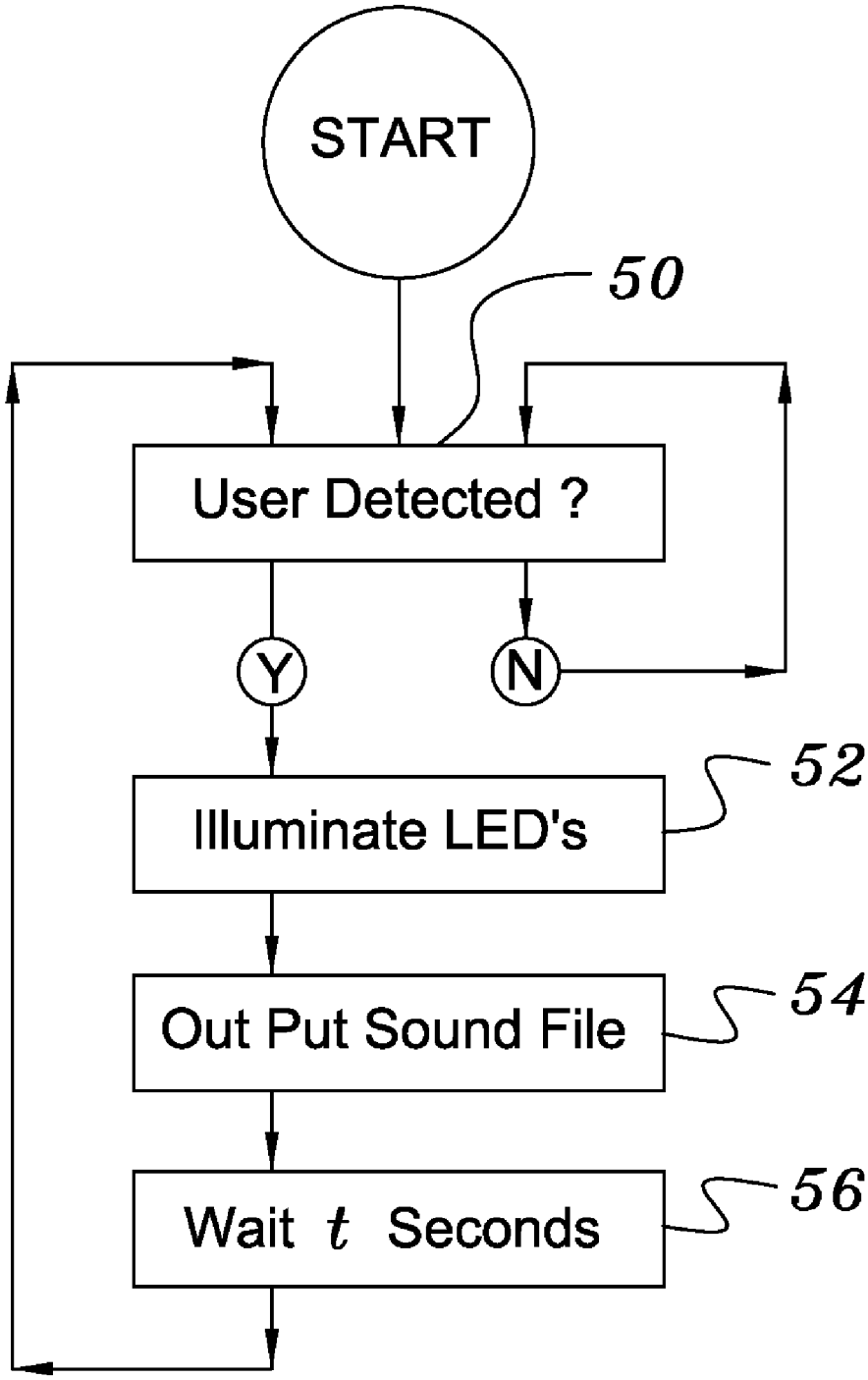
FIG. 2 is a flow chart depicting a method of operation of a system of the invention.
Figure 3:
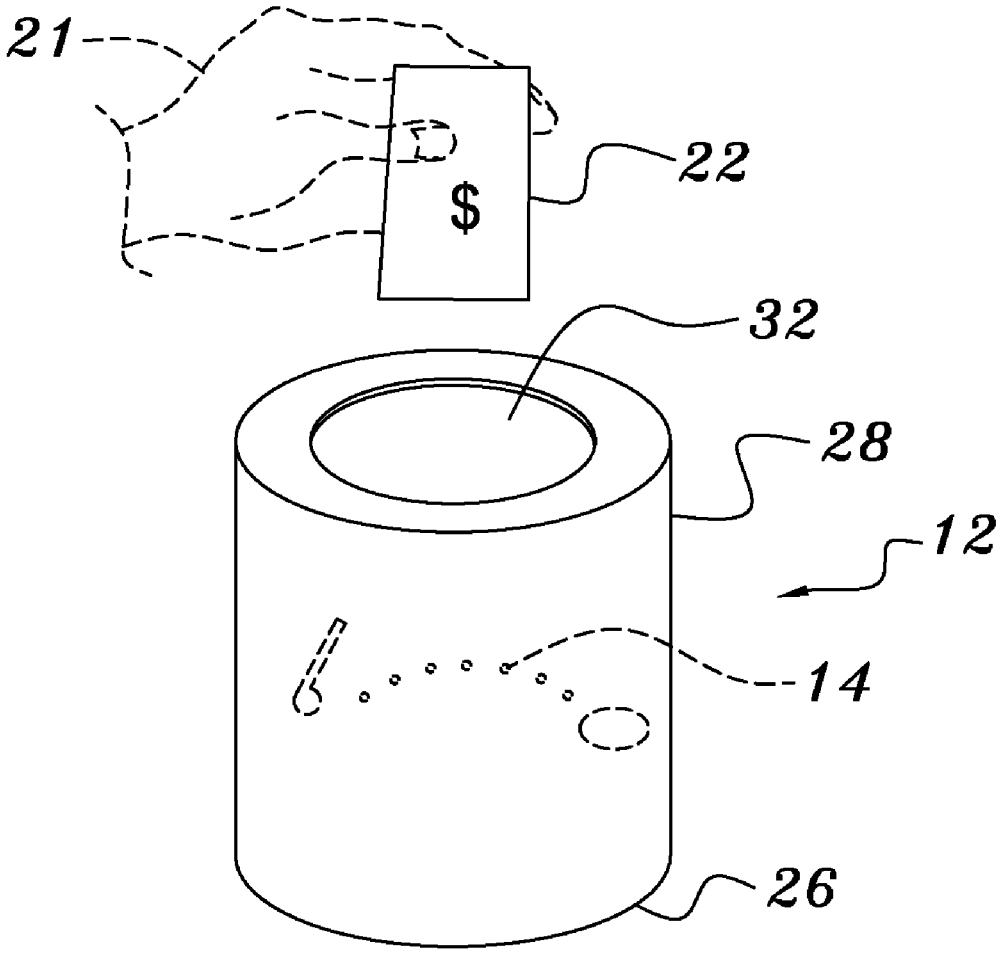
FIG. 3 is an elevational view of a second embodiment of the invention simulating a golfing event.

Turning now to FIG. 2, one finds a generic flow chart of a simple light and sound process of the invention. In this program, the controller, in Step 50 waits for a user to be detected by the capacitive sensing circuitry, and then, in Step 52, turns on the LEDs in desired sequence and subsequently operates the sound output, in Step 54. After the light and sound simulation is completed the controller waits (Step 56) for a long enough period of time for the user to remove his hand from the immediate vicinity of the sensing plate and then returns to the waiting mode. Numerous variations of this basic program are expected to be used with various embodiments of the invention. For example, in an embodiment in which the system simulates the flight of a golf ball followed by its landing in a water hazard, an initial sound output, representative of a club striking the ball, may precede the step of sequentially flashing a curved array of LEDs to simulate the ball's trajectory, following which a second sound output provides a sound representative of the ball falling into water. In another example, the rise and explosion of an aerial firework can be simulated by sequentially illuminating a more or less vertical string of LEDs, during which time a whistling output is supplied by the speaker, and after which the system provides the sound of an explosion, followed by sequential illumination of a second array of LEDs arranged so as to simulate the aerial burst. Thus, the audible and visible parts of the simulation may be provided in any order.

Moreover, it should be recognized that the single event of depositing money can be programmed to result in a plurality of possible outputs in a fashion that appears to be non-determinative to a user. Thus, a pseudo-random number generation algorithm executed by the controller could be used to generate one sound output most of the time and another sound output the rest of the time. For example, in the golf ball flight simulation discussed above, the audible output could be arranged to simulate a ball landing in a water hazard eighty percent of the time and to provide a cheering noise, representative of the ball landing on the green, twenty percent of the time.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. A system comprising, in combination, a receptacle for receiving a deposit of money and a signaling apparatus for responding to presence of a person depositing the money in the receptacle by providing a simulation of an action, wherein: the receptacle comprises a base, an upstanding wall surrounding the base so as to define a mouth portion of the receptacle, and a capacitive sensing plate adjacent the mouth portion; and the signaling apparatus comprises: an array of light sources; a capacitive sensing circuit electrically connected to the plate for providing an output when the person is proximate the plate; a controller connected to the capacitive sensing circuit to receive the output therefrom, the controller operable to provide respective outputs to the light sources in the array thereof and to a sound output device to generate the simulation having both visual and audible components.

2. The system of claim 1 wherein the array of light sources comprises a curvilinear array configured to represent a trajectory.

3. The system of claim 1 wherein the controller comprises computer memory and is operable under control of a program stored therein, and wherein the controller is operable to retrieve a file from the memory and generate therefrom the output to the sound output device.

4. The system of claim 1 wherein the plate comprises a wire loop disposed about the mouth of the receptacle.

5. The system of claim 1 wherein the light sources are arrayed along a vertical line in a housing comprising an upstanding member adjacent the receptacle and wherein the output from the controller acts to illuminate the light sources sequentially.

6. The system of claim 5 wherein the sound output device comprises a speaker and the output generated from the file, when applied to the speaker, causes a sound simulative of a gong.

7. The system of claim 1 wherein the sound output device comprises a speaker and the output generated from the file, when applied to the speaker, causes a sound simulative of a gong.

8. A method for indicating that a user has accessed a receptacle having a presence sensor associated therewith, the method comprising the steps of: a) determining, by means of the presence sensor, that the user is present; b) controlling, by means of a controller operating under control of a stored program, a curvilinear array of light sources to illuminate sequentially so as to create an illusion of motion of an object along a trajectory characteristic of an event; c) after creating the illusion of motion, generating, from a digital sound file stored in the memory, an audible output signal chosen so that the illusion of motion and the audible output signal, in combination, provide a simulation of the event.

9. The method of claim 8 wherein the presence sensor comprise a capacitive sensor comprising a plate disposed adjacent a mouth of the receptacle.

10. The method of claim 8 wherein the light sources are disposed in a housing comprising an elongated vertical body portion having a round portion at an upper end thereof, and wherein the audible output signal is output from the round portion to simulate a gong.

* * * * *